US007881943B2

(12) United States Patent
Santha

(10) Patent No.: US 7,881,943 B2
(45) Date of Patent: Feb. 1, 2011

(54) METHOD FOR SPEED CORRECTION OF AUDIO RECORDINGS

(75) Inventor: Sunil Baddaliyanage Santha, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 974 days.

(21) Appl. No.: 11/674,346

(22) Filed: Feb. 13, 2007

(65) Prior Publication Data

US 2008/0195399 A1 Aug. 14, 2008

(51) Int. Cl.
*G10L 21/04* (2006.01)

(52) U.S. Cl. ..... 704/503

(58) Field of Classification Search ..... 704/503
See application file for complete search history.

(56) References Cited

U.S. PATENT DOCUMENTS 5,313,011 A 5/1994 Koguchi
5,847,893 A 12/1998 Ishihara et al.
6,323,797 B1 11/2001 Kikumoto et al.
6,421,642 B1 7/2002 Saruhashi
6,490,553 B2 12/2002 Van Thong et al.
6,721,711 B1 4/2004 Hoshiai
6,748,357 B1 6/2004 Saruhashi

*Primary Examiner*—Susan McFadden
(74) *Attorney, Agent, or Firm*—Jeff LaBaw; Darcell Walker

(57) ABSTRACT

The method adjusts the playback speed of an audio recording such that the pitch of the playback is substantially the same as the pitch at the time of the original recording. Assuming tuned instruments were used for the recording, the method alters the playback speed of the recording to bring the pitch back to the original. The method should produce accurate results when correcting speed changes that were causing pitch errors less than or more than a semitone. The method can be used to correct pitch even when the first machine used for the recording had an incorrect recording speed. This method can be used to correct the speed of a nonmusical recording by referencing known frequencies or frequencies in the recording.

18 Claims, 4 Drawing Sheets

| Notes | | Frequency (Octaves) | | | |
|---|---|---|---|---|---|
| A | 55.00 | 110.00 | 220.00 | 440.00 | 880.00 |
| A# | 58.27 | 116.54 | 233.08 | 466.16 | 932.32 |
| B | 61.74 | 123.48 | 246.96 | 493.92 | 987.84 |
| C | 65.41 | 130.82 | 261.64 | 523.28 | 1046.56 |
| C# | 69.30 | 138.60 | 277.20 | 554.40 | 1108.80 |
| D | 73.42 | 146.84 | 293.68 | 587.36 | 1174.72 |
| D# | 77.78 | 155.56 | 311.12 | 622.24 | 1244.48 |
| E | 82.41 | 164.82 | 329.64 | 659.28 | 1318.56 |
| F | 87.31 | 174.62 | 349.24 | 698.48 | 1396.96 |
| F# | 92.50 | 185.00 | 370.00 | 740.00 | 1480.00 |
| G | 90.00 | 196.00 | 392.00 | 784.00 | 1568.00 |
| Ad | 103.83 | 207.66 | 415.32 | 830.64 | 1661.28 |

METHOD FOR SPEED CORRECTION OF AUDIO RECORDINGS

FIELD OF THE INVENTION

This invention relates to a method to correct the pitch or the speed of an audio recording during playback when the sound of the recording does not represent the original sound, that was recorded, due to the improper speed calibrations of recording/playback instruments used for dubbing and copying the audio recording during the recording's lifetime.

BACKGROUND OF THE INVENTION

A current copy of an old music recording may not run at the correct speed during playback. This problem is due to incorrect speed settings of playback and/or recording machines used when the recording was originally made or during subsequent copying. The desired solution is to playback the music at a pitch of the original sound of the recording without an error of the pitch.

A current way to implement the solution is to listen to the opening music of the recording and (change the playback speed to) match it with an existing opening music recording without a pitch error. This approach requires a listener with a good ear. Also required is another recording with a piece of the same music. If the second recording also has an error, the results will not be accurate. The results will be subjective. A second way to playback music at the pitch of the original recording is to change the length of the original recording. For example, if it is a half an hour program, adjust speed of the recording so that it plays for about 29 minutes. The drawback here is that it is useable only for recordings where the original playback time is exactly known. If the recording was originally made on a machine with an incorrect speed (and playback time of that recording was recorded) it will not be possible to Find the correct pitch of the original music using this method.

The general task of accurately reproducing sounds (audio waveforms) has been the subject of much research development. U.S. Pat. No. 6,721,771 describes an audio waveform reproduction apparatus. In this approach, the audio waveform reproduction apparatus includes a storage means for storing waveform data of the audio waveform, an input means for inputting reproduction tempo information, a first information production means for producing first information (TP) that is a time function based on the reproduction tempo information, a second information production means for producing second information (PP) that is a time function based on time axis compression/expansion information (TR), a compression/expansion information production means for comparing the first information and the second information and calculating the time axis compression/expansion information (TR) towards matching the temporal change of the second information with the temporal change of the first information, and a time axis compression/expansion processing means for performing time axis compression/expansion processing based on the time axis compression/expansion information (TR) to produce a reproduction audio waveform, wherein the first information (TP) and the second information (PP) represent positions on a common axis.

U.S. Pat. No. 6,490,553, describes a method for reproducing musical sounds is disclosed. Musical sounds and voices are stored and reproduced with user-definable timing and pitch, with the timing and pitch being independently controllable in real time. Musical sounds are stored in waveform memory, and pitch and timing information may be received in real time. The stored musical sounds and voices are then reproduced in accordance with the received pitch and timing information. The reproduction of stored musical sounds can also be stopped and resumed at user-definable marks.

U.S. Pat. No. 4,406,001, describes a time compression/expansion audio reproduction system of the type that provides pitch correction by repetitive variable time delay achieves improved performance by separating the reproduced signal from a recording into components, which are separately delayed. For studio quality reproduction the signal is separated into contiguous frequency bands, which are, each delayed synchronously and filtering each band signal after delay to eliminate high frequency components eliminates the processing noise in each band.

Although there have been numerous efforts to accurately reproduce sound/audio waveforms, with regard to the playback of musical recordings, there still remains a need for a method to adjust the pitch of the recording such that the pitch of a note at any point in the recording is similar in tone to the original pitch for that note.

SUMMARY OF THE INVENTION

The present invention provides a method that adjusts the playback speed of an audio recording such that the pitch of the playback is substantially the same as the pitch at the time of the original recording. Assuming tuned instruments were used for the recording, the method alters the playback speed of the recording to bring the pitch of the recording back to the pitch of the original recording. The method should produce accurate results when correcting speed changes that were causing pitch errors less than a semitone. Even when the speed changes caused pitch errors more than a semitone, pitch could be brought to the original when one knows the key of the piece of music. The method can be used to correct pitch even when the first machine used for the recording had an incorrect recording speed.

In the method of the present invention, a portion of an audio recording (in particular as musical recording) is (FFT) analyzed for its frequency components. Some of the dominant frequencies correspond to notes/codes in the music. Those frequencies are matched and compared with standard frequencies of the notes (scale). Then it is possible to calculate the deviation of the frequency of that particular note in the recording as a percentage. The playback speed of the audio recording is changed by that ratio to make the recording sound as if the instruments used in the recording were tuned to the standard notes (frequencies).

The recording should first be converted to digital form. This can be analyzed using FET software for the frequency content. The change could be applied in the form of length change of the recording or pitch correction (these produce the same result).

The method comprises the steps of: analyzing a portion of an audio recording, identifying a dominant point of the audio recording, matching the dominant points (s) with corresponding point(s) of the original recording, calculating the deviation between the identified point and the corresponding original point and adjusting the playback speed of the audio recording based on the calculated deviation such that the sound of the audio recording during playback is substantially the same as the sound of the original recording.

DETAILED DESCRIPTION OF THE INVENTION

Figures 1, 5:
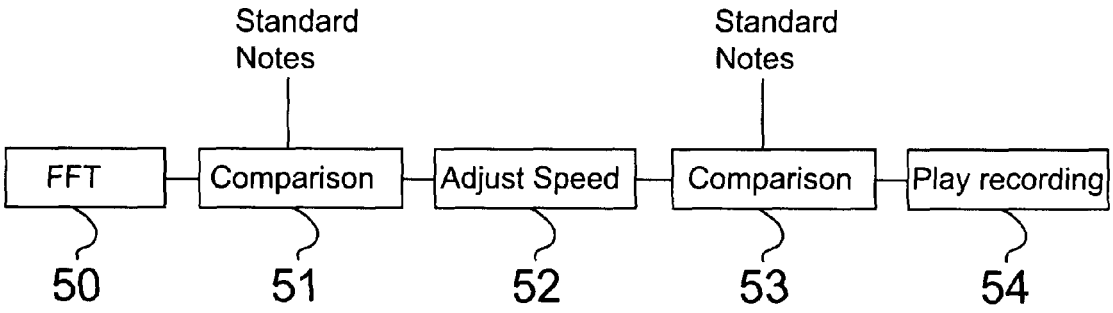
FIG. 1 is a chart that displays the frequencies for various musical notes.
FIG. 5 is a module illustration of the actions of the present invention.

For purposes of describing the method of the invention, the description will be in the context of a musical recording. The pitch of a musical sound is aurally defined by its absolute position in the scale and by its relative position with regard to other musical sounds. It is precisely defined by a vibration number recording the frequency of the pulsations of a tense string, a column of air, or other vibrator, in a second of time. The number of vibrations for a particular note is the frequency of that note. FIG. 1 is a chart that displays the frequencies for various musical notes. As shown, each note has a different frequency for each octave of the note.

Figure 2A:
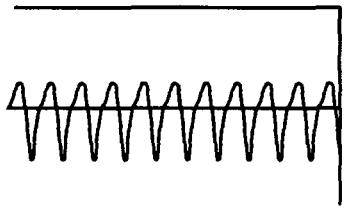
FIGS. 2*a*, 2*b* and 2*c* illustrate the frequency form for various musical notes.
Figure 2B:
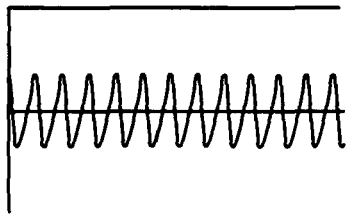
Figure 2C:
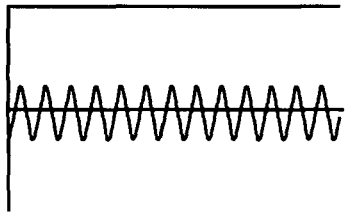

Each note is also has a representative audio frequency signal FIGS. 2*a*, 2*b* and 2*c* illustrate the frequency form for various musical notes. FIG. 2*a* is representative of note A. FIG. 2*b* is representative of note B. FIG. 2*c* is representative of note C. These signals can be illustrated through a conventional frequency spectrum analysis process. These distinct signals for notes of the recording can serve as identity points for the speed correction of the recording.

Figure 3:
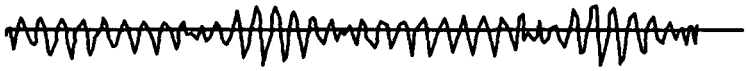
FIG. 3 illustrates the three notes of FIGS. 2*a*, 2*b* and 2*c* played together.

In addition to the analysis of individual notes of the recording, portions of the recording can be analyzed and a signal generated displaying the frequencies of notes for that portion of the recording. FIG. 3 illustrates a frequency analysis of a portion of a musical recording. This signal contains the frequencies for the notes of an identified portion of a sound recording. Several points of the recording are contained as possible points for notes. These points can be used in the process of the present invention.

In one embodiment, a key aspect of the present invention is to identify a portion of the original work that corresponds to a selected portion of the recorded work. In an alternate embodiment, identified notes of a recording can be compared to the standard pitch of a note. In this approach, it is not necessary to identify corresponding notes in an original recording of the work.

Figure 4:
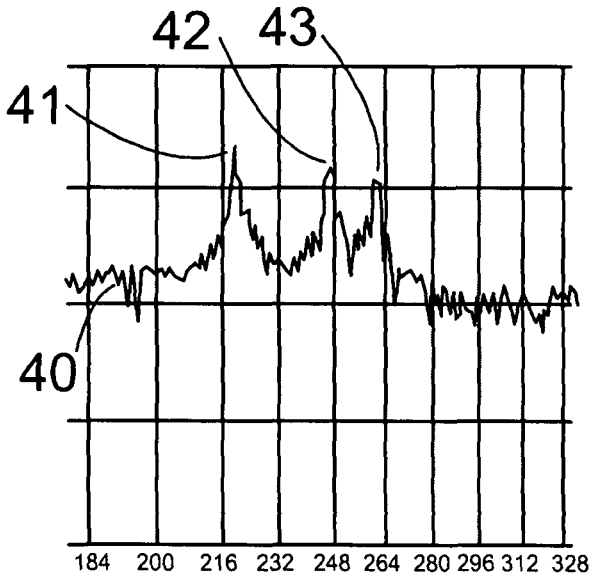
FIG. 4 is an illustration of FIG. 3 after frequency analysis, which produces the illustrated frequency spectrum.

FIG. 4 illustrates a frequency analysis of the segment of the recording illustrated in FIG. 3. The spectrum 40 was generated using a Fast Fourier Transform (FFT) procedure. The spectrum contains three main peaks, which can represent three notes of a recording segment. For example, shown in FIG. 4, peak 41 can represent a note A, peak 42 can represent a note B and peak 43 can represent a note C.

A premise for this method is that the degradation of the recorded signal is uniform. Therefore at each set of corresponding points of the signal, the deviation between the sets of corresponding points should be approximately the same. Referring to If the calculated deviations are substantially different, that result suggests that the analyzed segment of the recording is not the same segment of the reference. In other words, these are not corresponding segments of the recorded and reference works. Although the deviations may not be the same, there can be an established deviation range, which will constitute an approximate match. For example, the calculated deviations need to be within ten (10) percent of each other for there to be a confirmed match of the segments of the recorded and reference works.

FIG. 5 is a module illustration of the actions of the present invention. Initially, an identified segment of a recorded work can be analyzed using computer software that incorporates Fast Fourier Transform (FFT) techniques module 50. The corresponding segment of the reference work can also be analyzed with the FFT techniques. The FFTs are displayed as a frequency spectrum analysis that corresponds to the frequencies in the signals over a specified time period. The analysis of the works resulting from the FFT techniques sent to a comparator module 51. This comparator can identify the corresponding points of the two works and determine the amount of deviation between the corresponding frequencies. After there is a determination of the deviation between the corresponding points of the works, a speed adjuster module 52 will adjust the playback speed of the recorded work such that the frequencies of the recorded work match the frequencies (are the same as) of the reference work. The comparison module 53 can perform an optional comparison after the speed adjustment to confirm the matching of the recorded and reference segments. Module 54 is a playback of the recorded work at the adjusted playback speed.

Figure 6:
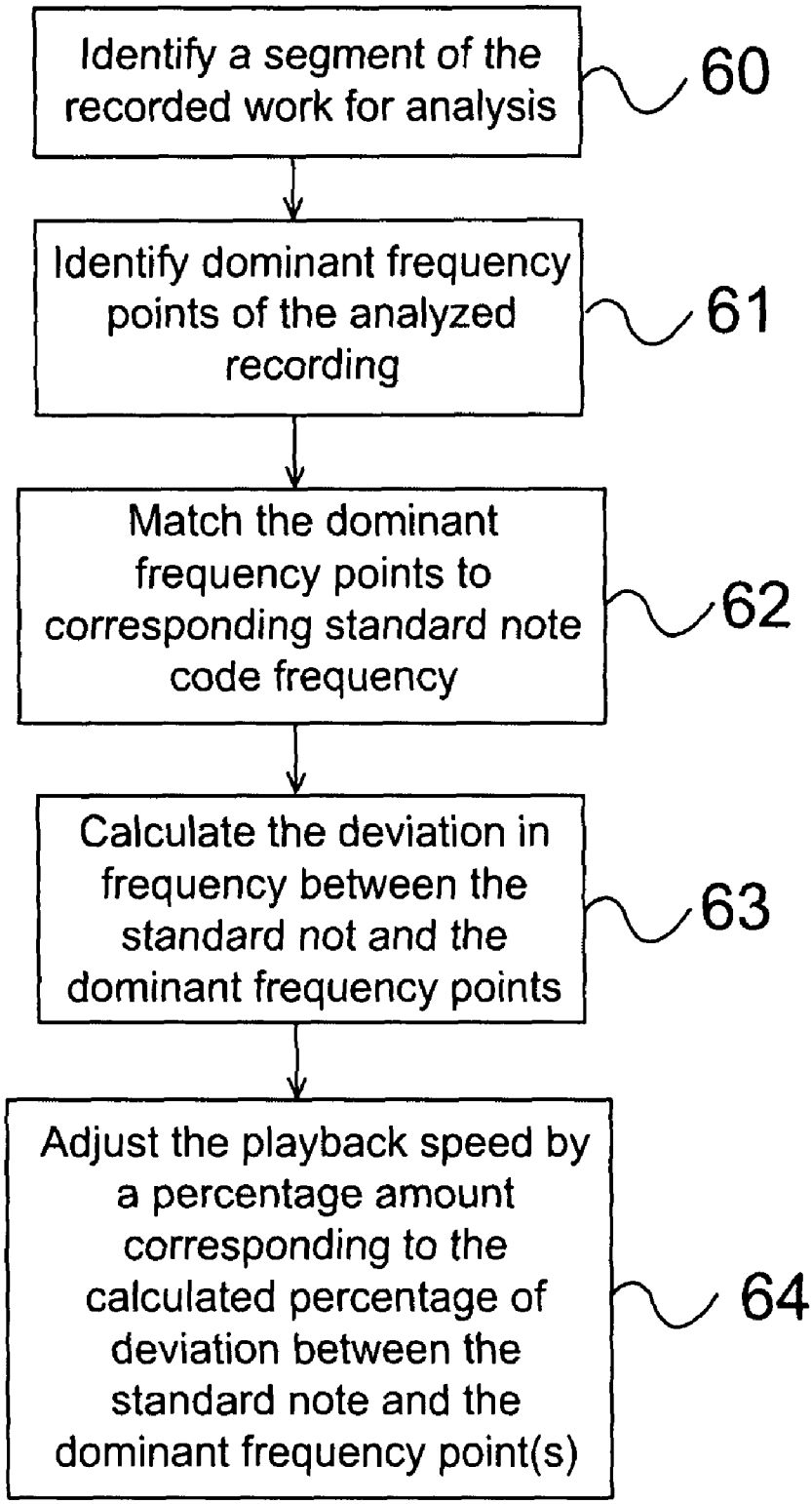
FIG. 6 is a flow diagram of the general steps in the implementation of the present invention.

FIG. 6 is a flow diagram of the general steps in the implementation of the present invention. As previously mentioned, the first step 60 is to identify a segment of the recorded work to be used in the analysis. Step 61 identifies dominant frequency points in the recording that can potentially be used to compare against the corresponding points of a reference recording. At this point, step 62 matches the dominant frequency points of the recorded work with corresponding points of the reference work. Step 63 calculates the difference in frequency between corresponding points of the recorded and reference works. The calculated difference between the corresponding points of the recorded and reference works is used to adjust the playback speed of the recorded work in step 64. The speed is adjusted such that the recorded work will have the same frequencies as the reference work.

Figure 7:
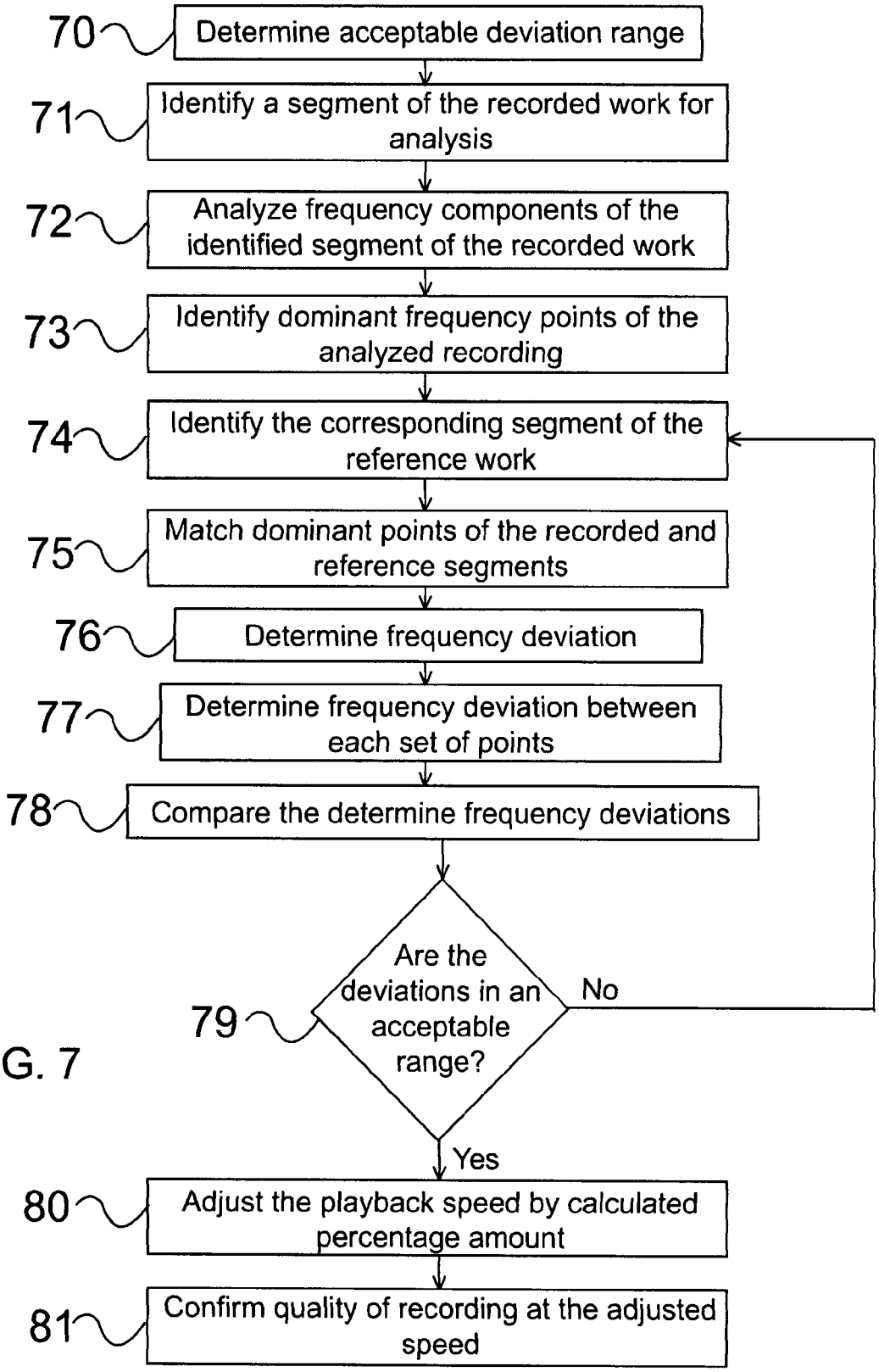
FIG. 7 is a flow diagram of a detailed implementation of the present invention.

FIG. 7 is a flow diagram of a detailed implementation of the present invention. In this process, an initial step 70 is to determine an acceptable deviation range. The explanation for this deviation range will be discussed later in the context of other steps. It is also necessary to identify a segment of the recorded work for analysis. This segment identification occurs in step 71. The analysis of this identified segment of the recorded work occurs in step 72. This analysis can be performed using a frequency or spectrum analyzer. The analyzer performs a Fast Fourier Transform (FFT). This analysis produces a display illustrating the frequencies of the notes in the identified segment. The display can be such as illustrated in FIG. 4. The analysis of step 72 enables the determination of dominant frequency points of the analyzed recording in step 73. The analyzed recording presents the dominant frequency points that standout in the recording and can provide easier reference points of the recording. These dominant points also present a pattern of the recorded work. The dominant frequency points can be a uniform frequency pattern at a certain amplitude. As previously illustrated certain musical notes have unique frequencies. If the analysis detects a frequency at one of the musical note frequencies, that point could be dominant point. The step can further record a set of dominant points that may be representative of a pattern. For example, the analysis may illustrate a frequency of 100 hertz (note A), a frequency of 141.84 hertz (note D) and a frequency of 180 hertz (note F#). This illustration results in a musical note pattern of A-D-F#. Even at a lower octave, this pattern should still be the same. In alternative, it is only necessary to use one frequency since the other frequencies should have the same deviation.

Step 74 uses the dominant frequency points and pattern of the dominant frequency points to identify corresponding the segment of the reference work. In the analysis of the reference work, this same pattern of A-D-F# can be detected. Even at different frequencies, for the same segment, this pattern should be the same for both the recorded and reference works. In the reference work, the frequencies could be 220 hertz (note A), 293.68 (note D) and 370 hertz (note F#). Step 75 matches the dominant points of the recorded and reference works. The match would be the 'A' notes, the 'D' notes and the 'F#' notes. Since the recorded notes are slightly below the octave frequencies, the pattern of notes could be used to determine the dominant points. In the alternative, the frequencies could be rounded to the nearest octave. For example, note A would have a rounded frequency of 110 hertz, note D a frequency of 146.84 hertz and note F# would have a frequency of 185 hertz. With this alternate approach, the amount of frequency needed to round the frequency must be considered.

Step 75 compares the matched dominant points of the recorded and reference segments. This comparison can be subtraction of one frequency from the other one. Step 76 takes the results of the comparison and determines the frequency deviation. With the result of the comparison, step 77 determines the frequency deviation between corresponding dominant points of the recorded and reference works. The reference frequency is twice the size of the recorded frequency in the present example, therefore the deviation is approximately 2. For each point, the deviation is the same 2. Step 78 makes a comparison of the deviations of the corresponding points. In the present case, there is no difference in the deviations of the corresponding dominant points.

With musical works the same notes can appear at several places in the work. If the segments of the recorded and reference works arc the same, the calculated deviations for the sets of corresponding points should be the same. A smaller the average, means the points of the recorded work and the reference work are close together. If one set of points (A) had a deviation that was three times the size of the other sets of points, this large deviation of corresponding points (A) would suggest that these segments of the recorded and reference works are not the same segment. As mentioned, if these were the same segments, the deviations of the sets of points should be approximately the same.

Step 79 makes the determination of whether the average of the deviations of the sets of corresponding points is within the acceptable range for validation that the segments are the same for both works. For example, if the range was five percent and the deviations were within five percent of each other then this range would be acceptable. If the deviations are in an acceptable range, the method moves to step 80 where there is an adjustment in the playback speed of the recorded work. The speed adjustment in direct relation to the deviation between the recorded and reference works. For example, if the points of the recorded work are approximately 20 hertz below the corresponding points of the reference work, then the playback speed is adjusted such that the frequency of the recorded work increases by 20 hertz. This increase in frequency will cause the recorded work to sound approximately the same as the reference work during a playback of the recorded work. To increase the frequency, it is necessary to increase the playback speed of he recorded work. At this point an optional step 81 can verify the quality of the modified recorded work to confirm that the recorded work sounds approximately the same as the reference work. Comparing common points and calculating the deviation between the points can do this confirmation. When the works are the same, there should be no deviation. Referring back to step 79, if the deviation is out of the range, this result suggests that there is not a proper match of the segments from the recorded and reference works. In this case, the method returns to step 74 where a new reference segment is generated. With this new segment, the process then repeats steps 75 through 79.

In addition to the techniques described herein other statistical techniques and spectral fitting techniques can be used in the implementation of the matching step. Further, the dominant sound can be of any sound on the reference recording. These sounds can include background sounds such as air conditioner noises.

It is important to note that while the present invention has been described in the context of a fully functioning data processing system, those skilled in the art will appreciate that the processes of the present invention are capable of being distributed in the form of instructions in a computer readable medium and a variety of other forms, regardless of the particular type of medium used to carry out the distribution. Examples of computer readable media include media such as EPROM, ROM, tape, paper, floppy disc, hard disk drive, RAM, and CD-ROMs and transmission-type of media, such as digital and analog communications links.

I claim:

1. A method for correcting the speed of a recorded audio work and verifying that the recorded audio work is played at the correct speed, the method comprising the steps of:

selecting a portion of a recorded audio work;

identifying dominant points of the recorded work by performing frequency spectrum analysis of the selected portion of the recorded audio work, the dominant points being frequencies in the recorded work above an identified amplitude;

matching the identified dominant points with corresponding defined points previously identified of a reference;

generating an adjusted playback speed by calculating a deviation between the matched points of the reference and recorded works;

adjusting the playback speed of the entire recorded work such that the playback speed of the recorded work is modified to approximately the same sound as an original work; and playing the modified work at the adjusted speed.

2. The method as described in claim 1 wherein the reference is an absolute value of a musical note in the recorded audio work.

3. The method as described in claim 1 wherein said frequency spectrum analysis step further comprises analyzing the selected portion of the audio work using a Fast Fourier Transform (FFT) technique.

4. The method as described in claim 1 wherein the dominant points are frequencies of musical notes.

5. The method as described in claim 1 wherein the dominant points are musical pitches.

6. The method as described in claim 1 wherein said adjusting step further comprises changing the playback speed of the recorded work until the frequencies of the dominant points of the recorded work equal the corresponding points of the reference frequencies.

7. The method as described in claim 1 further comprising before said matching step, the step of establishing a deviation range to be used in determining whether there is a match between a dominant point of the recorded work and a real note corresponding to a reference point.

8. The method as described in claim 7 wherein said matching step further comprises:

identifying one or more corresponding points of the recorded work and the reference work;

calculating the deviation between corresponding points;

comparing the calculated deviations of the corresponding points; and determining whether the deviations arc in the deviation range.

9. The method as described in claim 8 wherein said determining step further comprises averaging the calculated deviations.

10. The method as described in claim 1 further comprising after said adjusting step, the step of confirming the quality of the recorded work at the adjusted speed.

11. The method as described in claim 1 wherein the reference is an original recording of the recorded audio work.

12. A computer program product in a non-transitory computer readable medium for correcting the speed of a recorded audio work and for verifying that the recorded audio work is played at the correct speed, comprising:

instructions selecting a portion of a recorded audio work;

instructions identifying dominant points of the recorded work by performing frequency spectrum analysis of the selected portion of the recorded audio work, the dominant points beine frequencies in the recorded work above an identified amplitude;

instructions matching the identified dominant points with corresponding points of a reference work:

instructions generating an adjusted playback speed by calculating a deviation between the matched points of the reference and recorded works; and instructions adjusting the playback speed of the entire recorded work such that the playback speed of the recorded work is modified to approximately the same sound as an original work; and instructions playing the modified work at the adjusted speed.

13. The computer program product as described in claim 12 wherein said frequency spectrum analysis instructions further comprise instructions for analyzing the selected portion of the audio work using a Fast Fourier Transform (FFT) technique.

14. The computer program product as described in claim 12 wherein said adjusting instructions further comprise instructions for increasing the playback speed of the recorded work until the frequencies of the dominant points of the recorded work equal the frequencies of the corresponding dominant points of the reference work.

15. The computer program product as described in claim 12 further comprising before said matching instructions, instructions for establishing a deviation range to be used in determining whether there is a match between a dominant point of the recorded work and the corresponding point of the reference work.

16. The computer program product as described in claim 15 wherein said matching instructions further comprise: instructions for identifying one or more corresponding points of the recorded work and the reference work; instructions for calculating the deviation between corresponding points; instructions for comparing the calculated deviations of the corresponding points: and instructions for determining whether the deviations are in the deviation range.

17. The computer program product as described in claim 16 wherein said determining instructions further comprise instructions for averaging the calculated deviations.

18. The computer program product as described in claim 12 further comprising after said adjusting instructions, instructions for confirming the quality of the recorded work at the adjusted speed.

* * * * *